US008434639B2

(12) United States Patent
Markert

(10) Patent No.: US 8,434,639 B2
(45) Date of Patent: May 7, 2013

(54) ONE PIECE, PUSH BUTTON, FLIP TOP CLOSURE

(75) Inventor: Brooks R. Markert, Harwinton, CT (US)

(73) Assignee: C & N Packaging, Inc., Wyandanch, NY (US)

( * ) Notice: Subject to any disclaimer, the term of this patent is extended or adjusted under 35 U.S.C. 154(b) by 1078 days.

(21) Appl. No.: 11/820,159

(22) Filed: Jun. 18, 2007

(65) Prior Publication Data

US 2008/0023477 A1 Jan. 31, 2008

Related U.S. Application Data

(60) Provisional application No. 60/919,213, filed on Mar. 21, 2007, provisional application No. 60/814,836, filed on Jun. 19, 2006.

(51) Int. Cl.

| | |
|---|---|
| ***B65D 43/24*** | (2006.01) |
| ***B65D 43/14*** | (2006.01) |
| ***B65D 51/04*** | (2006.01) |
| ***B65D 43/26*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 51/24*** | (2006.01) |

(52) U.S. Cl.

USPC ..... 220/831; 220/815; 220/826; 220/262; 220/263; 215/237; 215/301; 215/303

(58) Field of Classification Search ..... 220/831, 220/815, 826, 262, 263; 215/237, 301, 303
See application file for complete search history.

(56) References Cited

U.S. PATENT DOCUMENTS

| | | | |
|---|---|---|---|
| 1,131,774 A | 3/1915 | Davis | |
| 5,143,234 A | 9/1992 | Lohrman et al. | 215/235 |

(Continued)

FOREIGN PATENT DOCUMENTS

| | | |
|---|---|---|
| EP | 0 819 615 | 1/1998 |
| FR | 2 849 429 | 7/2004 |

OTHER PUBLICATIONS

European Search Report dated Jun. 17, 2009 (six pages).
Notification Concerning Transmittal of International Preliminary Report on Patentability (Chapter I of the Patent Cooperation Treaty).
International Preliminary Report on Patentability, Mar. 7, 2008.

*Primary Examiner* — Anthony Stashick
*Assistant Examiner* — Andrew T Kirsch
(74) *Attorney, Agent, or Firm* — Gerald T. Bodner

(57) ABSTRACT

A push button, flip top closure for a container, includes a base portion, a push button actuator situated on the base portion and twistingly mounted thereon to pivotally rotate with respect to the base portion, a central cap having an orifice formed through the thickness thereof, the push button actuator at least partially surrounding the central cap, and a lid hingedly mounted to the base portion and positionable between at least a closed position to cover the orifice formed in the central cap and an open position to uncover the orifice formed in the central cap. The push button actuator selectively forces the lid to pivot to the open position to allow the contents of the container on which the closure is mounted to pass through the orifice in the central cap.

9 Claims, 14 Drawing Sheets

U.S. PATENT DOCUMENTS 5,573,127 A * 11/1996 Takahashi et al. ..... 215/237
6,834,769 B2 * 12/2004 Takahashi et al. ..... 215/235
7,000,792 B2 2/2006 Arai
2006/0151416 A1 7/2006 Hennemann et al. ..... 215/235

* cited by examiner

ONE PIECE, PUSH BUTTON, FLIP TOP CLOSURE

CROSS-REFERENCE TO RELATED APPLICATIONS

This application is related to U.S. Provisional Application Ser. No. 60/814,836, filed on Jun. 19, 2006, and entitled "One Piece, Push Button, Flip Top Closure" and to U.S. Provisional Application Ser. No. 60/919,213, filed on Mar. 21, 2007, and entitled "One Piece, Push Button, Flip Top Closure", the disclosure of each of which is incorporated herein by reference and on which priority is hereby claimed.

BACKGROUND OF THE INVENTION

1. Field of the Invention

This invention generally relates to closures and lids for containers, and more particularly relates to pivoting closures for plastic bottle or tube-like containers holding a quantity of a dispersible pharmaceutical or cosmetic product, such as toothpaste and lotions, for example.

2. Description of the Prior Art

Many containers for pharmaceutical and cosmetic products currently on the market require a two-handed operation for removing the closure or cap from the container to access the contents of the container, for example, toothpaste and lotion containers that include a screwed-on cap. Other containers include flip top closures which are separately formed from multiple parts that must be assembled together, requiring additional manufacturing time and labor, and are relatively complicated in structure.

OBJECTS AND SUMMARY OF THE INVENTION

It is an object of the present invention to provide a flip top closure for a container which may be injection molded as one continuous piece.

It is another object of the present invention to provide a flip-top closure for a container carrying a pharmaceutical or cosmetic product which is easy to open and close.

It is another object of the present invention to provide a one piece, push button, flip top closure for a tube or bottle containing toothpaste, lotion or the like which is operable by a consumer using one hand.

It is a further object of the present invention to provide a one piece, push button, flip top closure for a container that may be bi-injected molded to provide various components of the closure with different colors.

It is yet another object of the present invention to provide a one piece, push button, flip top closure that overcomes the inherent disadvantages of conventional closures.

In accordance with one form of the present invention, a one piece, push button, flip top closure for a container includes a cylindrical base, a U-shaped push button actuator integrally formed with the base and twistingly mounted thereon to partially rotate with respect to the base, a central cap having an orifice formed through the thickness thereof, the U-shaped push button actuator at least partially surrounding the central cap, and a lid hingedly mounted to the base to cover and uncover the central cap and the orifice formed therein. The push button actuator, when pressed, forces the lid to open to allow the contents of the container on which the closure is mounted to pass through the orifice in the central cap.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
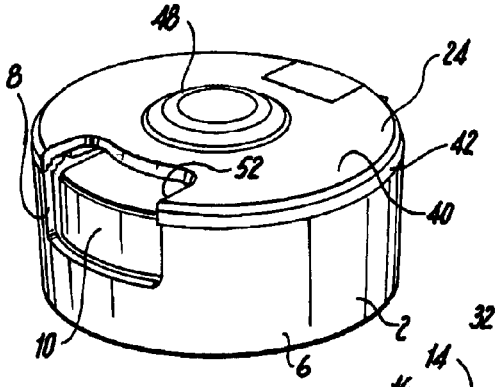
FIG. 1 is top isometric view of a first embodiment of the one piece, push button, flip top closure of the present invention, the closure being shown in a closed position.
Figure 2:
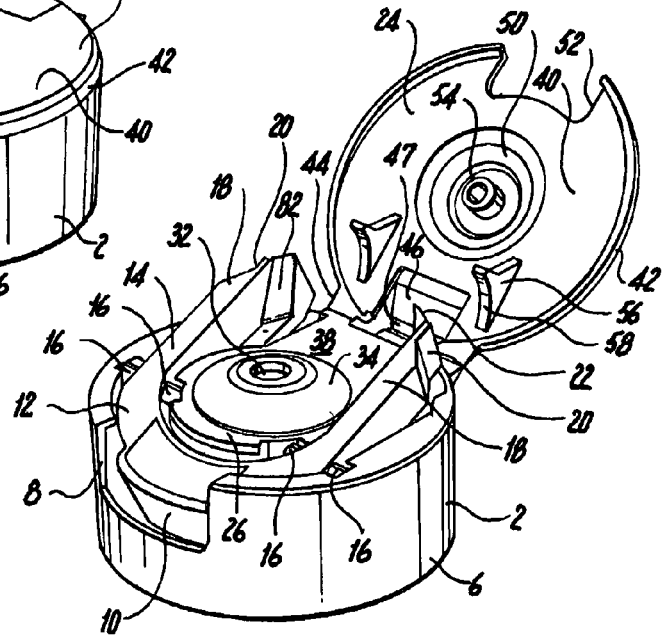
FIG. 2 is a top isometric view of the first embodiment of the one piece, push button, flip top closure of the present invention shown in FIG. 1, the closure being shown in an open position.

The one piece, push button, flip top closure of the present invention is illustrated by FIGS. 1-10 of the drawings. The first embodiment of the closure of the present invention is illustrated by FIGS. 1 and 2. In this embodiment, the cylindrical base 2 of the closure does not include knurling 4 on its outer side wall 6, as is included in the second embodiment of the present invention illustrated by FIGS. 3-10 of the drawings. The side wall 6 of the base 2 of the first embodiment of the closure includes a substantially smooth surface. Other than the difference in the base side wall 6 of the closure described above, the first and second embodiments of the one piece, push button, flip top closure of the present invention have similar structure and, accordingly, both embodiments of the present invention will be described in detail together, with reference to FIGS. 1-10 of the drawings.

It will be seen from the drawings that a one piece, push button, flip top closure constructed in accordance with the present invention includes a base 2 which is generally cylindrical in shape, although other shapes, such as square, rectangular or oval, for the base are envisioned to be within the scope of the present invention. The cylindrical base 2 may have its side wall 6 formed with or without knurling 4, which knurling 4 provides a better grip for the closure if the closure is threadingly secured to the container and is desired to be removed therefrom. The knurling 4 also provides a decorative feature to the closure of the present invention, although it is envisioned to be within the scope of the present invention to form the closure with other decorative features known to one skilled in the art.

The cylindrical base 2 includes a notch 8 formed through the thickness of the side wall 6. As will be explained in greater detail, the notch 8 is provided to reveal or expose a finger engagement portion 10 (i.e., the push button) of a push button actuator 12 of the closure so that the push button actuator may be pressed by a user.

The one piece, push button, flip top closure of the present invention also includes the push button actuator 12, as mentioned above. The push button actuator 12 is preferably in the form of a U-shaped member 14 that is twistingly joined to an inside surface of the cylindrical base 2 on opposite lateral sides of the actuator 12. More specifically, the U-shaped member 14 is integrally molded to the base 2 and thus attached thereto by twist pin extensions 16 joining the inside surface of the cylindrical base 2 and the opposite lateral outer sides of the U-shaped member 14. The U-shaped member 14 thus can partially rotate on the cylindrical base 2, with the pin extensions 16 slightly twisting to permit such rotation.

The U-shaped member 14 of the push button actuator 12 includes on one side of the twist pin extensions 16 two spaced apart arms 18. Each arm 18 includes a free end 20, each free end 20 having an exposed edge 22 that engages the lid 24 to pivot the lid on the cylindrical base 2. The U-shaped member 14 also includes a finger engagement portion 10 situated on the opposite side of the twist pin extensions 16. The finger engagement portion 10 is in the form of a protrusion, which is also referred to herein as the push button, that is received by the notch 8 formed in the side wall 6 of the cylindrical base 2 and is exposed therethrough for the user to press with his or her finger to open the lid 24 of the closure.

Figure 6:
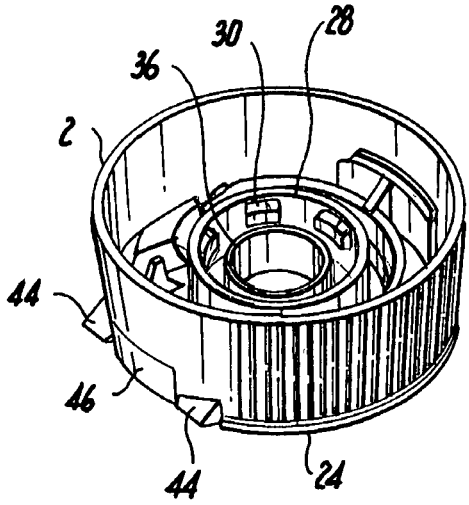
FIG. 6 is a bottom isometric view of the second embodiment of the closure of the present invention shown in FIGS. 3 and 4, the closure being shown in the closed position.
Figure 7:
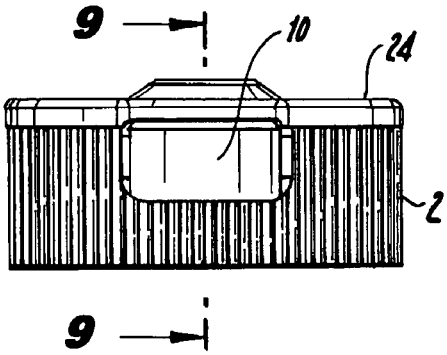
FIG. 7 is a side view of the second embodiment of the closure of the present invention shown in FIGS. 3 and 4, the closure being shown in the closed position.
Figure 8:
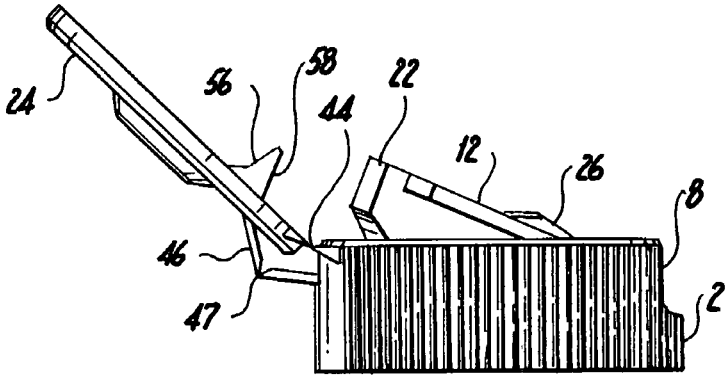
FIG. 8 is a side view of the second embodiment of the closure of the present invention shown in FIGS. 3 and 4, the closure being shown in the open position.
Figure 9:
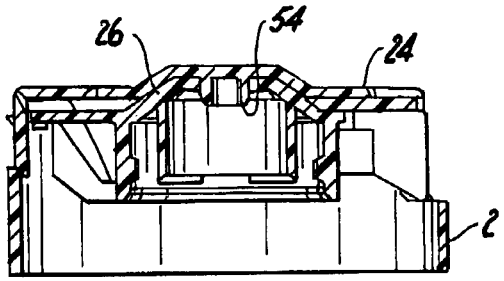
FIG. 9 is a cross-sectional view of the second embodiment of the closure of the present invention shown in FIGS. 3 and 4, taken along line A-A of FIG. 7.
Figure 10:
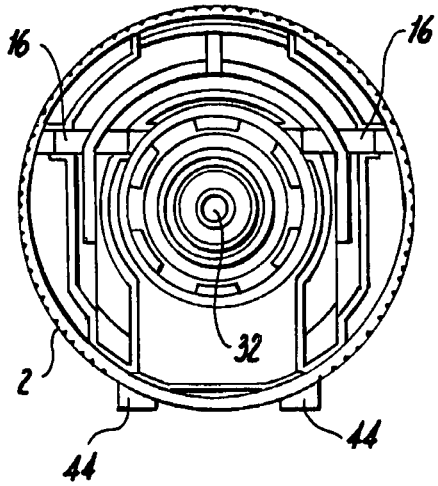
FIG. 10 is a top plan view of the second embodiment of the closure of the present invention shown in FIGS. 3 and 4, with the lid portion of the closure being omitted from the figure.
Figure 11:
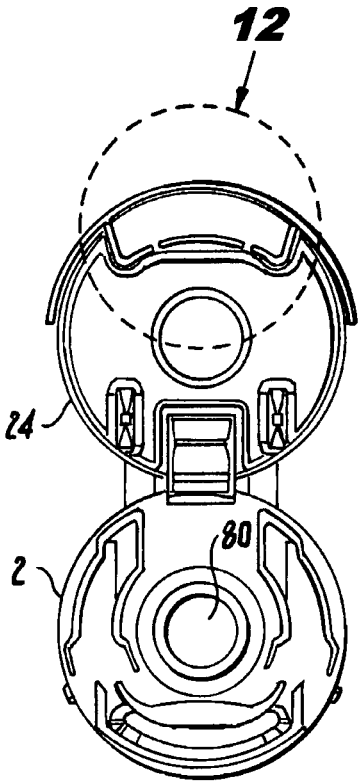
FIG. 11 is a top plan view of a third embodiment of the closure of the present invention, with the closure being shown in the open position.
Figure 12:
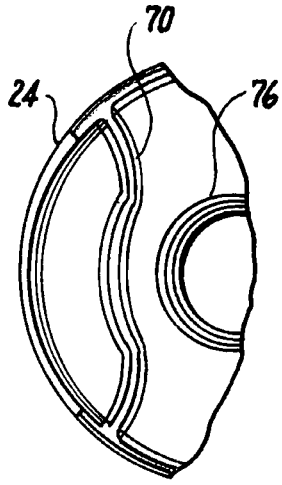
FIG. 12 is a top plan view of a portion of the lid of the closure of the present invention shown in FIG. 11, and viewing the underside thereof.
Figure 13:
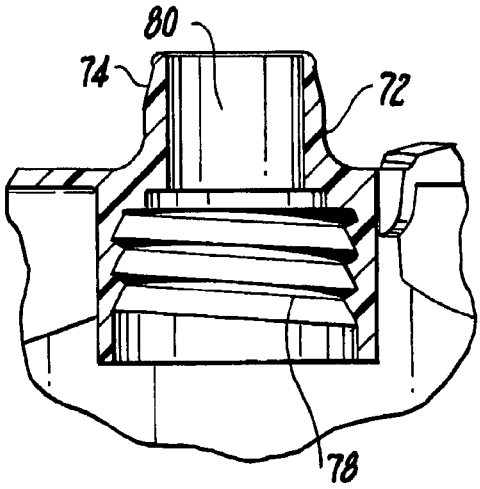
FIG. 13 is a cross-sectional view of a threaded nozzle portion of the closure shown in FIGS. 11 and 12.
Figure 14:
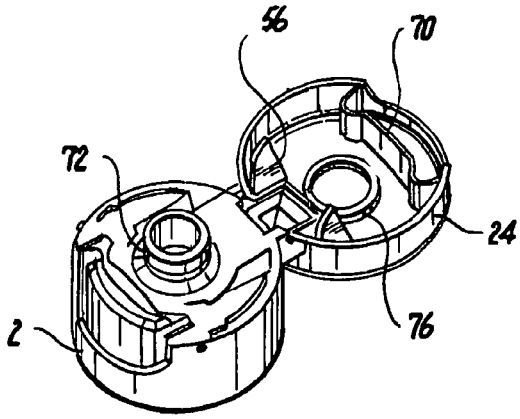
FIG. 14 is a top isometric view of the third embodiment of the closure of the present invention shown in FIGS. 11-13, and illustrating the closure in the open position.
Figure 15:
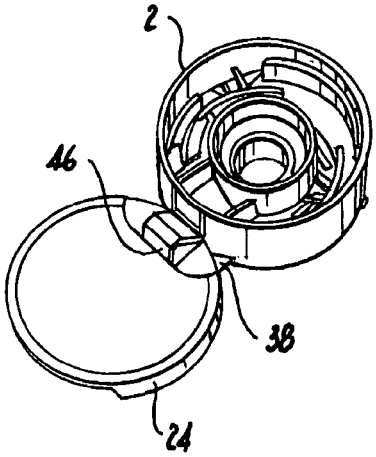
FIG. 15 is a bottom isometric view of the second embodiment of the closure of the present invention, and illustrating the closure in the open position.

The one piece, push button, flip top closure of the present invention also includes a central cap 26 that is straddled by the spaced apart arms 18 of the U-shaped member 14. The central cap 26 is provided for mating with a container on which the closure is mounted and, in particular, the neck of the container. The central cap 26 may includes threads (not shown) formed on an interior cylindrical wall 28 thereof, which threads would cooperate with the threaded neck of the container on which the closure is mounted. Alternatively, and as shown in FIG. 6 of the drawings, the interior cylindrical wall 28 of the central cap 26 may include tabs 30 extending outwardly from a radially inner surface thereof, which tabs 30 resiliently cooperate with a ring, shoulder or a lip (not shown) that may be provided on the neck of the container on which the closure is mounted. Accordingly, the closure of the present invention may be threadingly secured to the container and may be removed therefrom by unscrewing the closure from the container, or may be press-fitted onto and secured to the container and not removable therefrom.

The central cap 26 includes an orifice 32 formed centrally through the thickness thereof, the orifice 32 being provided to allow the contents of the container on which the closure is mounted to pass therethrough for use by the consumer. The orifice 32 may be centered on a conical protrusion 34 formed on and extending from the upper surface of the top wall of the central cap 32. The central cap 32 may further include a cylindrical ring 36 situated concentrically within the interior wall 28 of the cap to help direct the contents of the container toward and through the orifice 32 of the central cap.

It should be noted here that, preferably, the U-shaped member 14 of the push button actuator 12 is twistingly joined to the central cap 26 by twist pin extensions 16 also extending between the lateral inner sides of the spaced apart arms 18 and the outer surface of the side wall of the central cap 26 so that the U-shaped member 14 partially rotates with respect to both the cylindrical base 2 and the central cap 26. It should also be noted that the central cap 26 is rigidly joined to and integrally formed with the cylindrical base 2, as is seen from FIGS. 2 and 4 of the drawings by a piece 38 connecting the central cap to the base.

The one piece, push button, flip top closure of the present invention also includes a lid 24. The lid 24 includes a top wall 40 and a small side wall 42 joined peripherally to the top wall. The lid 24 is pivotally mounted to the cylindrical base 2. More specifically, a living hinge 44 connects an edge of the side wall 42 of the lid 24 to the side wall 6 of the cylindrical base 2 to allow the lid 24 to pivot with respect to the cylindrical base 2. A strap hinge 46 is also included and also has a living hinge 47. The strap hinge 46 extends from the upper surface of the top wall 40 of the lid to the outer surface of the side wall 6 of the cylindrical base 2 and is provided to maintain the lid 24 in an open position at preferably about one hundred, thirty-five degrees (135°) or some other obtuse angle defined between the top surface of the cylindrical base 2 and the bottom surface of the top wall of the lid 24. This particular angle is preferred, as the closure, when in the open position, has its lid 24 positioned sufficiently away from the cylindrical base 2 and orifice 32 of the central cap 26 so as not to interfere with the dispensing of the contents of the container through the closure orifice.

The top wall 40 of the lid 24 is substantially planar, although it may include a central conical protrusion 48 extending outwardly from the top surface thereof and a complementary conical indentation or recess 50 formed in the lower surface thereof. The recess 50 is provided to receive the conically shaped portion 34 of the top surface of the central cap 26 and so as to allow the lid 24 to be closely received on the central cap 26, with the side wall 42 of the lid closely engaging and resting on the top surface of the cylindrical base 2. Furthermore, a cutout 52 is formed in the top wall 40 of the lid and over a portion of the lid side wall 42, which cutout 52 is aligned with the notch 8 formed in the side wall 6 of the cylindrical base 2 when the lid 24 is in the closed position and resting on the top surface of the cylindrical base. The cutout 52, which extends partially radially and partially circumferentially on the top wall 40 of the lid, exposes the finger engagement portion 10 of the push button actuator 12 so that a user may press the push button to pivot the lid 24 with respect to the cylindrical base 2.

The lid 24 is further formed with a boss 54 extending outwardly from the lower surface of the top wall 40 thereof, and more particularly, from the conical recess 50 formed in the lower surface thereof. The boss 54 is dimensioned so that it may be closely received by the orifice 32 to seal the orifice formed in the central cap 26 and to prevent the contents of the container on which the closure is mounted from being inadvertently dispensed. The boss 54 may have a rounded or beveled edge, or may itself be conically shaped, so as to facilitate its proper seating within the orifice 32 of the central cap and to allow the lid 24 to freely pivot on the cylindrical base 2 even if there is a build up of material or residue of the container contents surrounding the orifice 32 of the central cap 26.

To further effect the pivoting of the lid 24 with respect to the cylindrical base 2, the lid further includes a pair of camming protrusions 56 extending outwardly from the lower surface of the lid top wall 40. The camming protrusions 56 are spaced apart from one another and aligned with the free end edges 22 of the spaced apart arms 18 of the U-shaped member 14. The camming protrusions 56 have curved camming surfaces 58 which are engaged by the spaced apart arms 18 of the U-shaped member when the push button actuator 12 is forced to partially rotate on the cylindrical base 2.

To open the push button, flip top closure of the present invention, a user presses on the finger engagement portion 10 of the push button actuator 12 at the notch 10 formed in the cylindrical base side wall 6 and the cutout 52 formed in the top wall 40 of the lid. Pressure on the finger engagement portion 10 causes the push button actuator 12 to twistingly rotate on the cylindrical base 2, causing the two spaced apart arms 18 to lift and engage at its free end edges 22 the camming protrusions 56 of the lid. This engagement between the push button actuator 12 and the camming protrusions 56 forces the lid 24 to pivot with respect to the cylindrical base 2 to a particular angle at which the strap hinge 46 pulls the lid open further to the non-interfering, obtuse angle shown in FIG. 8 and maintains the lid 24 in this open position with respect to the cylindrical base 2. The boss 54 situated on the lid is unseated from the orifice 32. The orifice 32 is now open to allow the contents of the container on which the closure is mounted to freely pass therethrough and to be dispensed as desired by the user.

To close the push button, flip top closure of the present invention, finger pressure is exerted on the lid 24 to pivot the lid toward the cylindrical base 2. The camming protrusions 56 on the lid engage the free end edges 22 of the spaced apart arms 18 of the push button actuator 12, forcing the push button actuator 12 to twist on the cylindrical base 2 to its original position, with the finger engagement portion 10 again residing in the notch 8 and cutout 52 respectively formed in the cylindrical base side wall 6 and lid top wall 40, and with the boss 54 being again received by the orifice 32 formed in the central cap 26 to seal the orifice and to prevent the contents of the container on which the closure of the present invention is mounted from being inadvertently dispensed.

A unique feature of the closure of the present invention is that it is injection molded as one continuous piece, which simplifies the manufacturing process and eliminates or minimizes any labor in assembling the closure. The closure may also be formed by using bi-injection molding technology to yield a two color closure, where certain components, such as the push button actuator 12 and the remainder of the closure, are provided in different colors.

The closure of the present invention may be designed to have either a snap-on or threaded cylindrical base 2, as described previously, providing the closure with greater flexibility to work with plastic bottles, tottles, tubes or other containers having threaded necks or other structural features for attaching the closure to the container.

Figure 3:
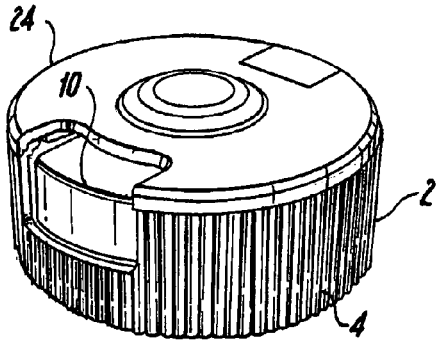
FIG. 3 is a top isometric view of a second embodiment of the one piece, push button, flip top closure of the present invention, the closure being in a closed position.
Figure 4:
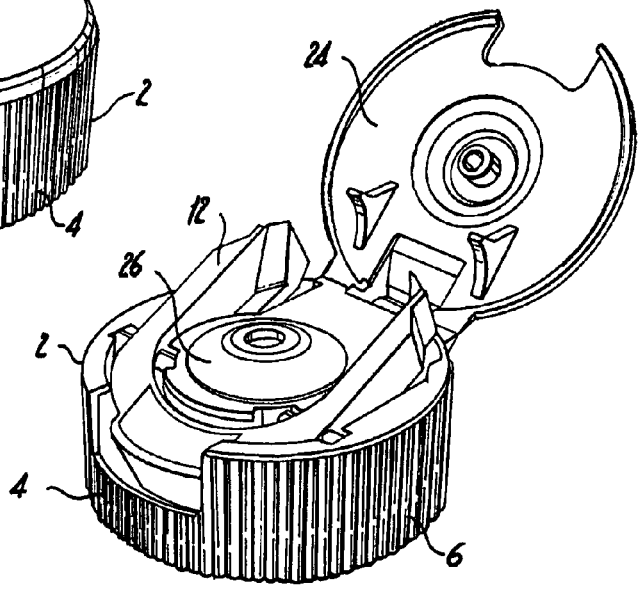
FIG. 4 is a top isometric view of the second embodiment of the one piece, push button, flip top closure of the present invention shown in FIG. 3, the closure being in an open position.
Figure 5:
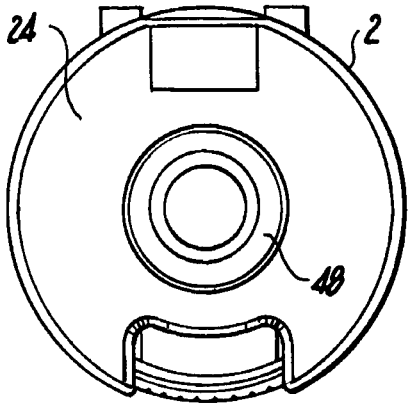
FIG. 5 is a top plan view of the second embodiment of the closure of the present invention shown in FIGS. 3 and 4, the closure being shown in the closed position.

The closure of the present invention may also be designed to have flat top surface on its lid 24 rather than the conical surface shown in FIG. 3 to allow the container to rest in an inverted position on the closure. This inverted stance allows the contents in the container to drain towards the closure, facilitating the evacuation of a partially filled container.

It should also be realized that the push button actuator 12 need not specifically be in the form of the U-shaped member 14 described previously, and it is envisioned to be within the scope of the present invention to form the push button actuator 12 in other shapes and configurations to force the lid 24 to pivot on the base 2 when the actuator 12 is pressed by the user.

The closure of the present invention may also be designed to be "tamper evident". This could be achieved by adding thin "tabs" (not shown) to hold the push button actuator 12, and in particular the finger engagement portion 10 thereof, in place. The consumer would break such tabs by pressing on the push button actuator 12 when the closure is first used.

FIGS. 11-33 illustrate a third embodiment of the closure of the present invention, and its operation. This third embodiment is similar in structure and operation to the first and second embodiments described previously and shown in FIGS. 1-10. In this third embodiment of the closure of the present invention, one modification includes adding an internal wall 70 to obscure from the viewer the mechanism for lifting the lid portion 24 of the closure off the base portion 2. That internal wall 70 extends outwardly perpendicularly from the underside surface of the lid 24, and preferably extends to the top surface of the base 2 when the lid is properly seated on the base in the closed position.

Another feature of the third embodiment of the present invention shown in FIGS. 11-30 is the inclusion of a nozzle 72 protruding outwardly perpendicularly from the upper surface of the base 2, and more preferably, from the upper surface of the central cap 26, which nozzle 72 has a beveled or sloped edge 74 that is received in a complementary shaped recessed boss 76 extending from the underside of the lid and aligned with the nozzle 72 of the base. Furthermore, the base 2 includes an interiorly threaded portion 78 which defines a passageway that communicates with the opening or bore 80 of the nozzle 72 to allow the passage of fluid or materials therethrough. The interiorly threaded portion 78 may be screwed on to the threaded neck of a container, such as a toothpaste container, for example, so that the contents of the container may pass through the base 2 and nozzle 72, as desired by the user, when the closure is mounted on the container.

Figure 22:
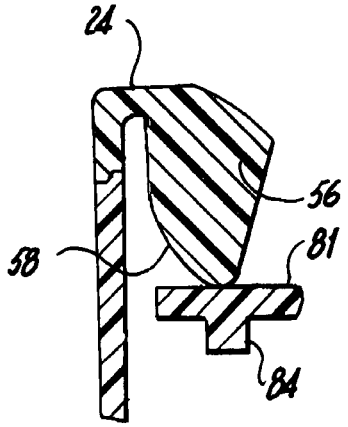
FIG. 22 is a cross-sectional view of the closure of the present invention shown in FIG. 18, taken along line D-D of FIG. 18.
Figure 23:
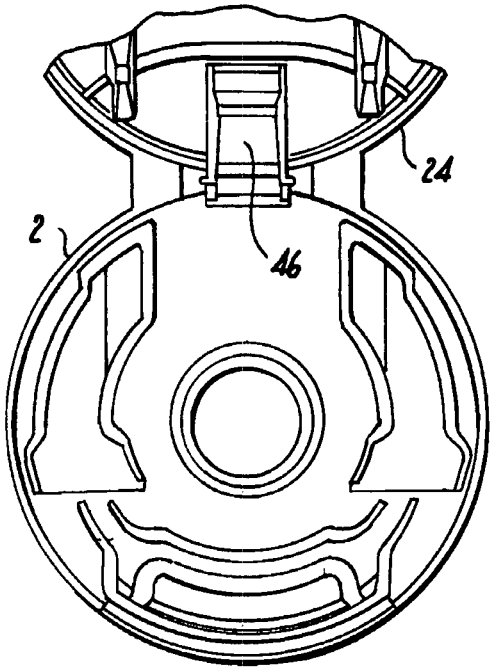
FIG. 23 is a top plan view of a portion of the closure of the present invention shown in FIGS. 11 through 22, and illustrating the closure in an open position.
Figure 24:
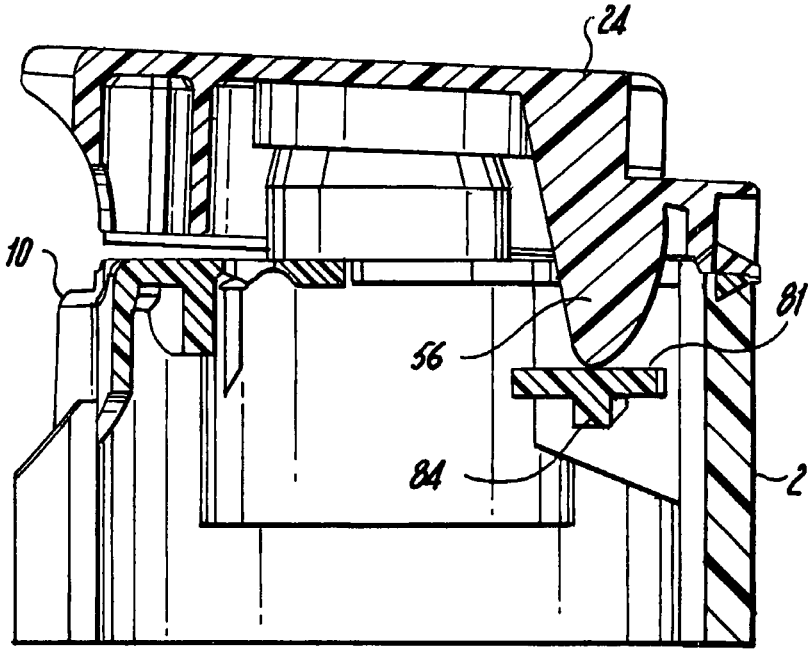
FIGS. 24 through 33 are cross-sectional views of the third embodiment of the closure of the present invention shown in FIGS. 11 through 23, and illustrating in sequence the engagement of the various components of the closure that causes the lid portion of the closure to lift off the base portion to uncover the nozzle of the closure.
Figure 25:
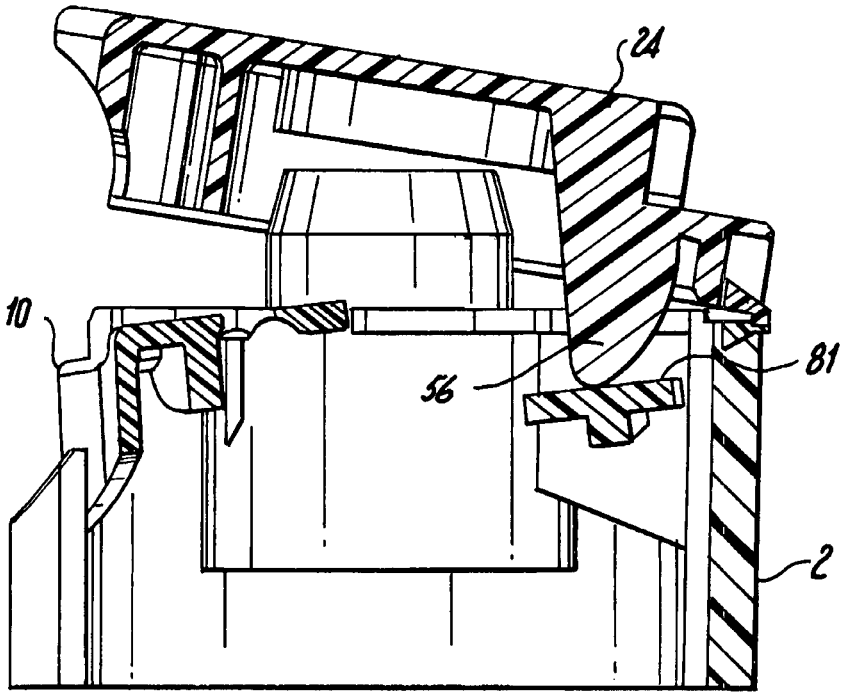
Figure 26:
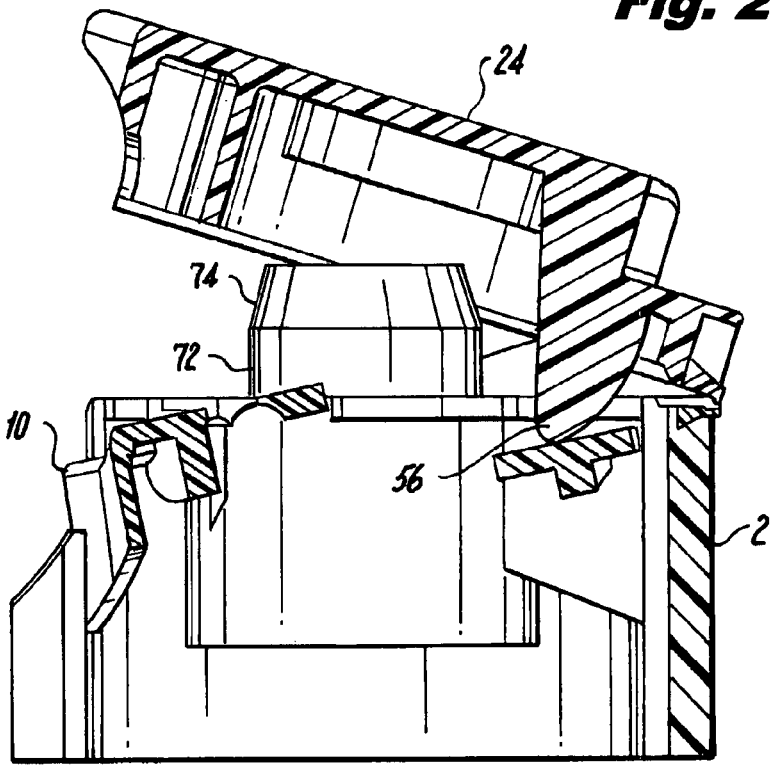
Figure 27:
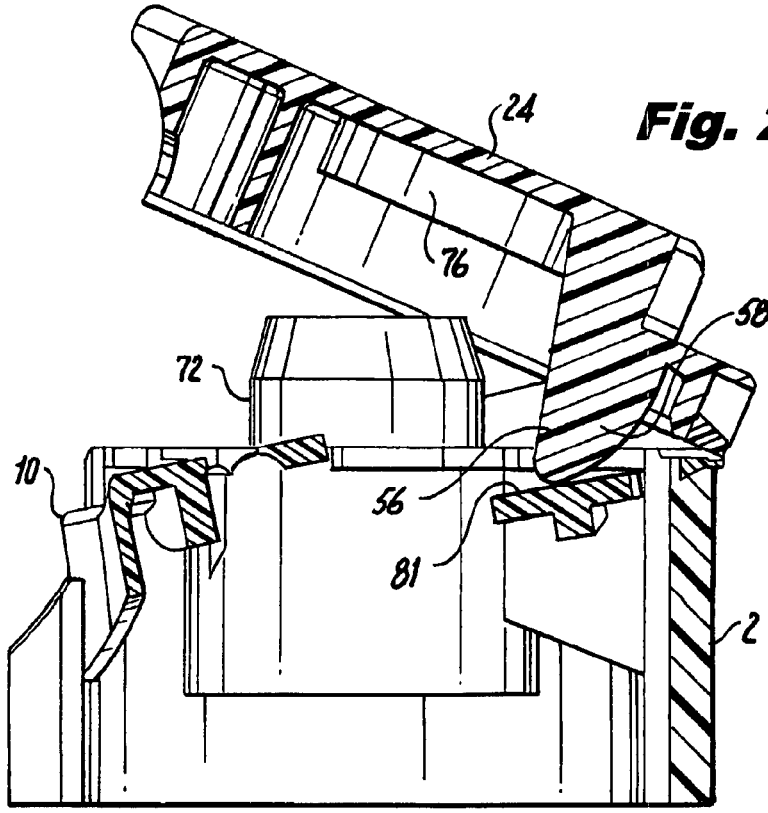
Figure 28:
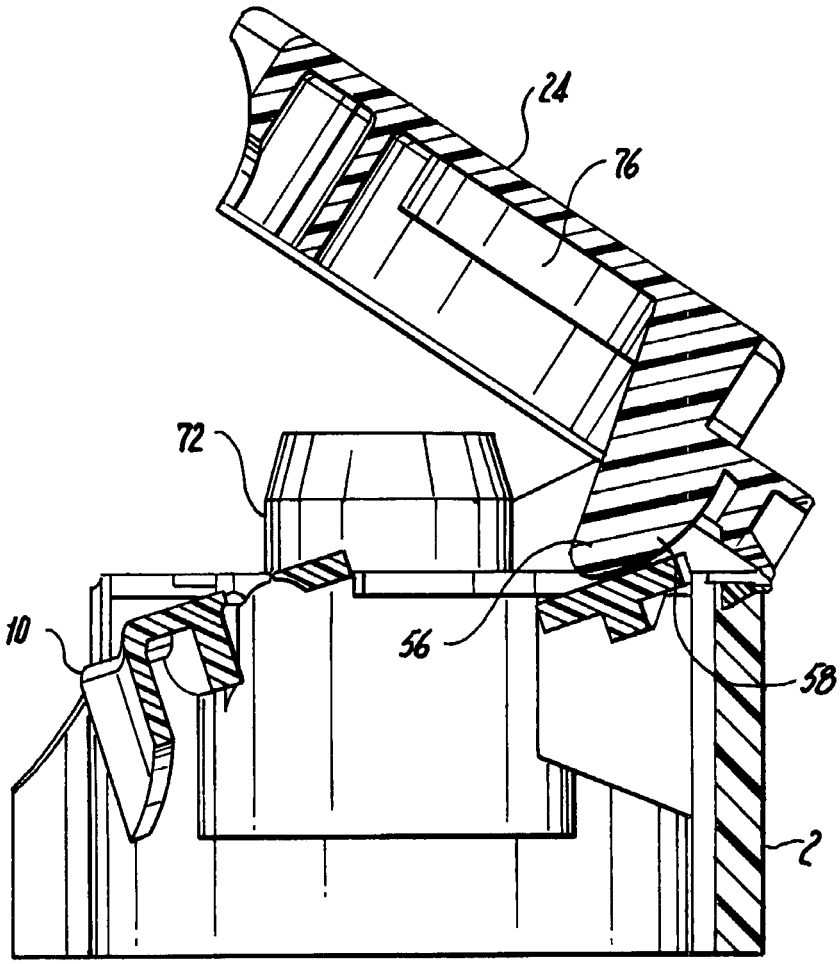
Figure 29:
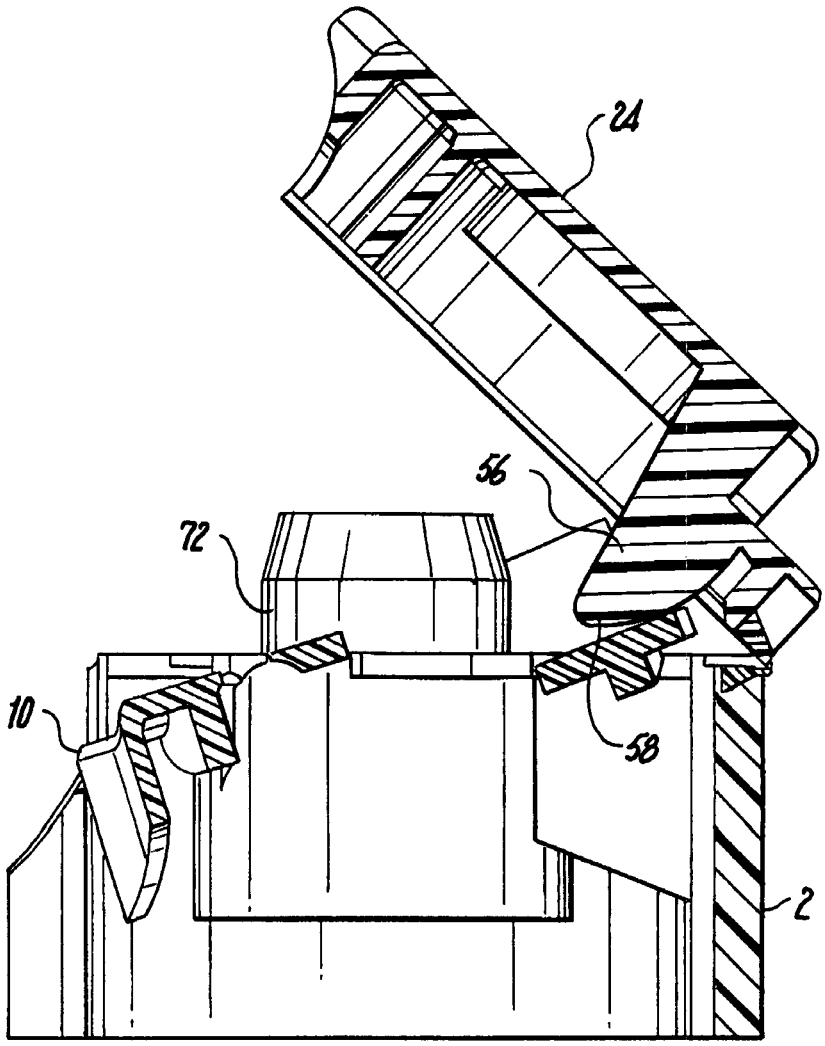
Figure 30:
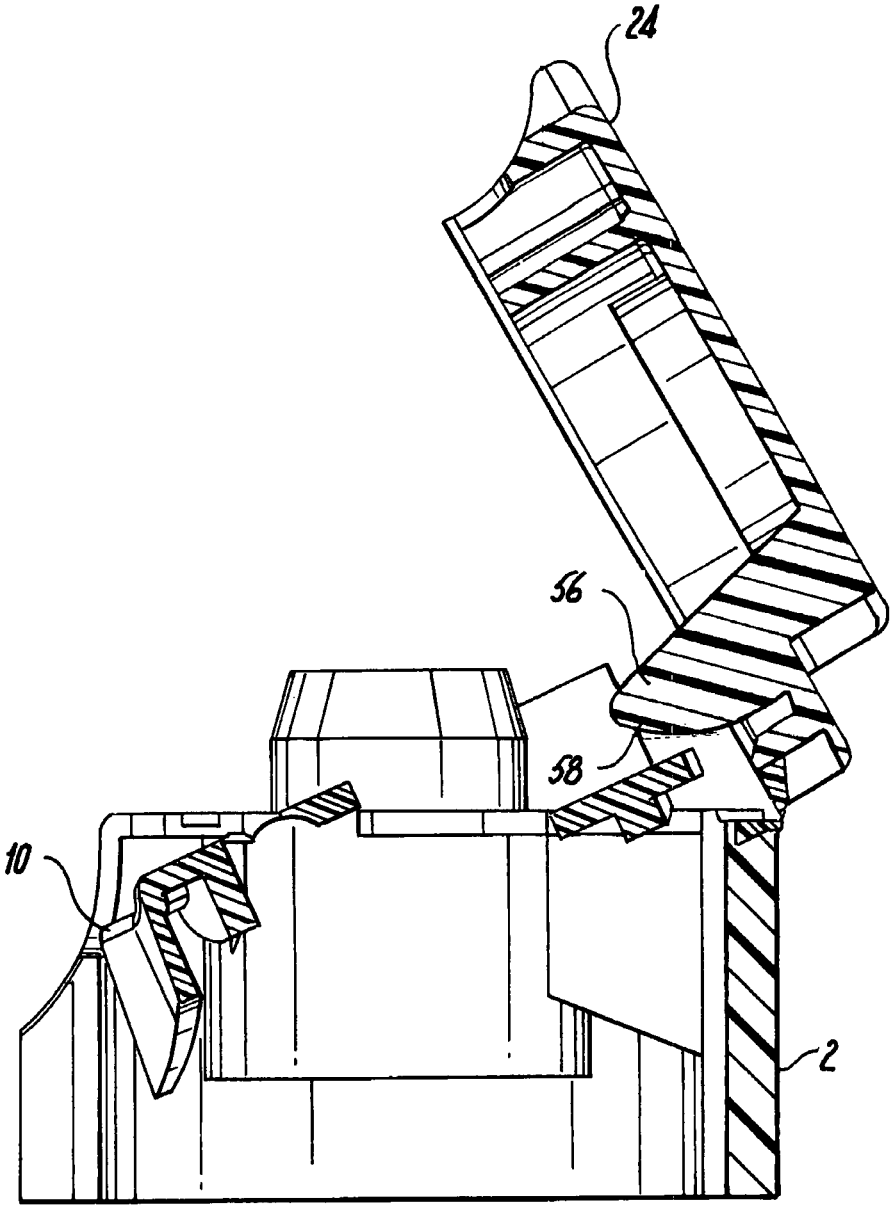
Figure 31:
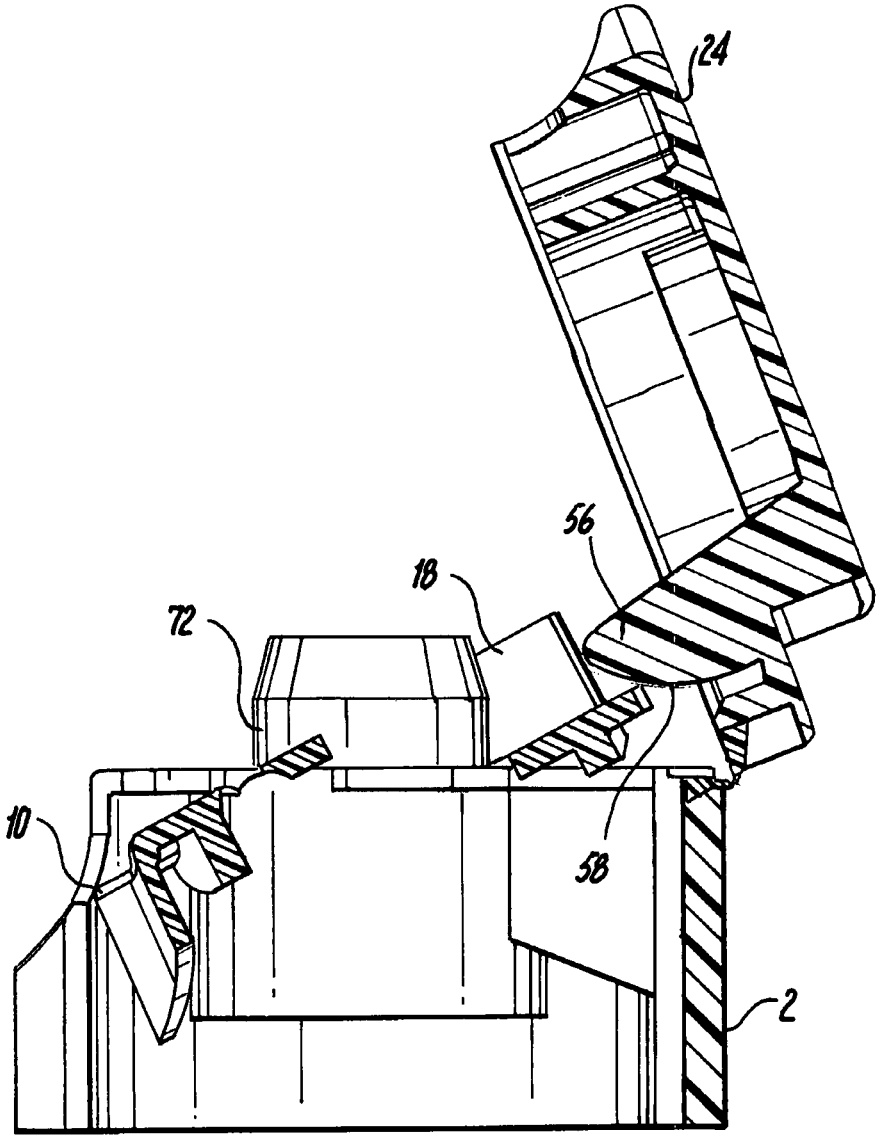
Figure 32:
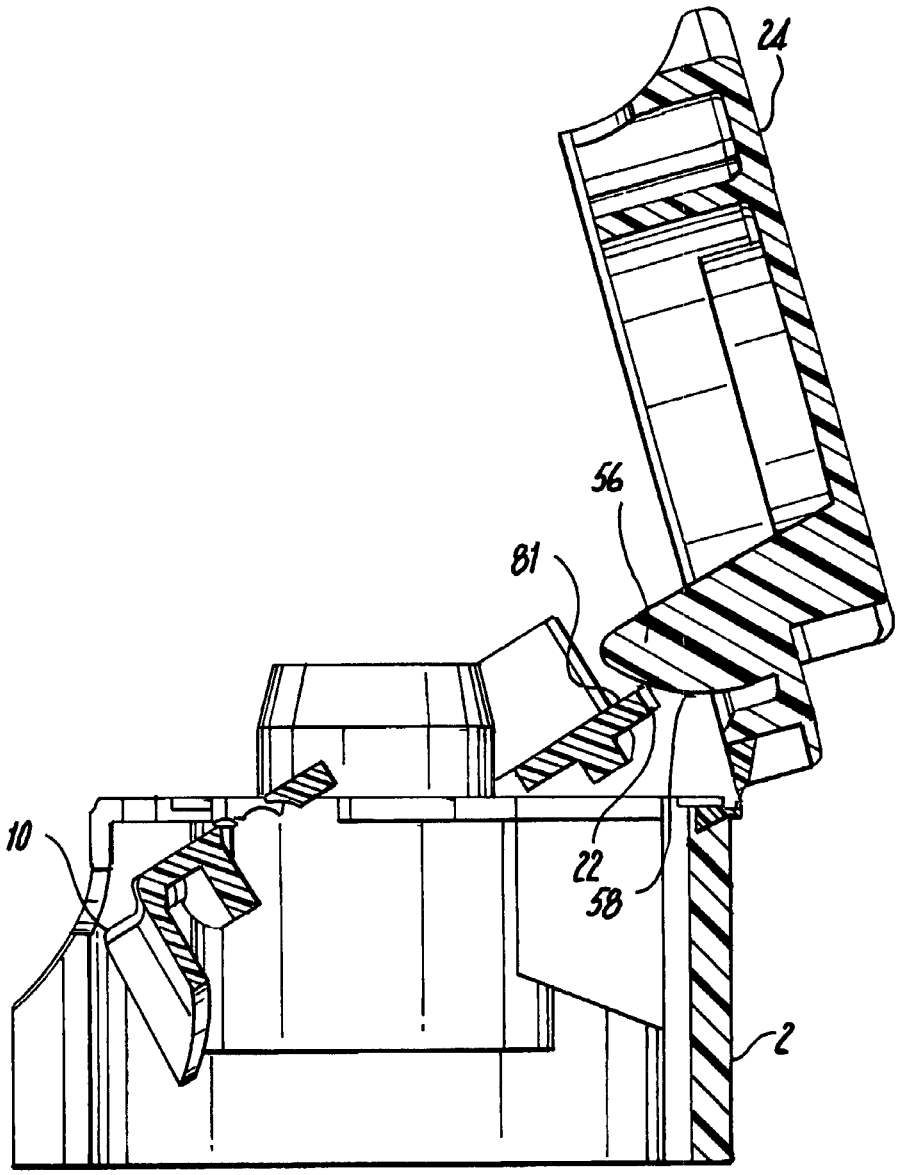
Figure 33:
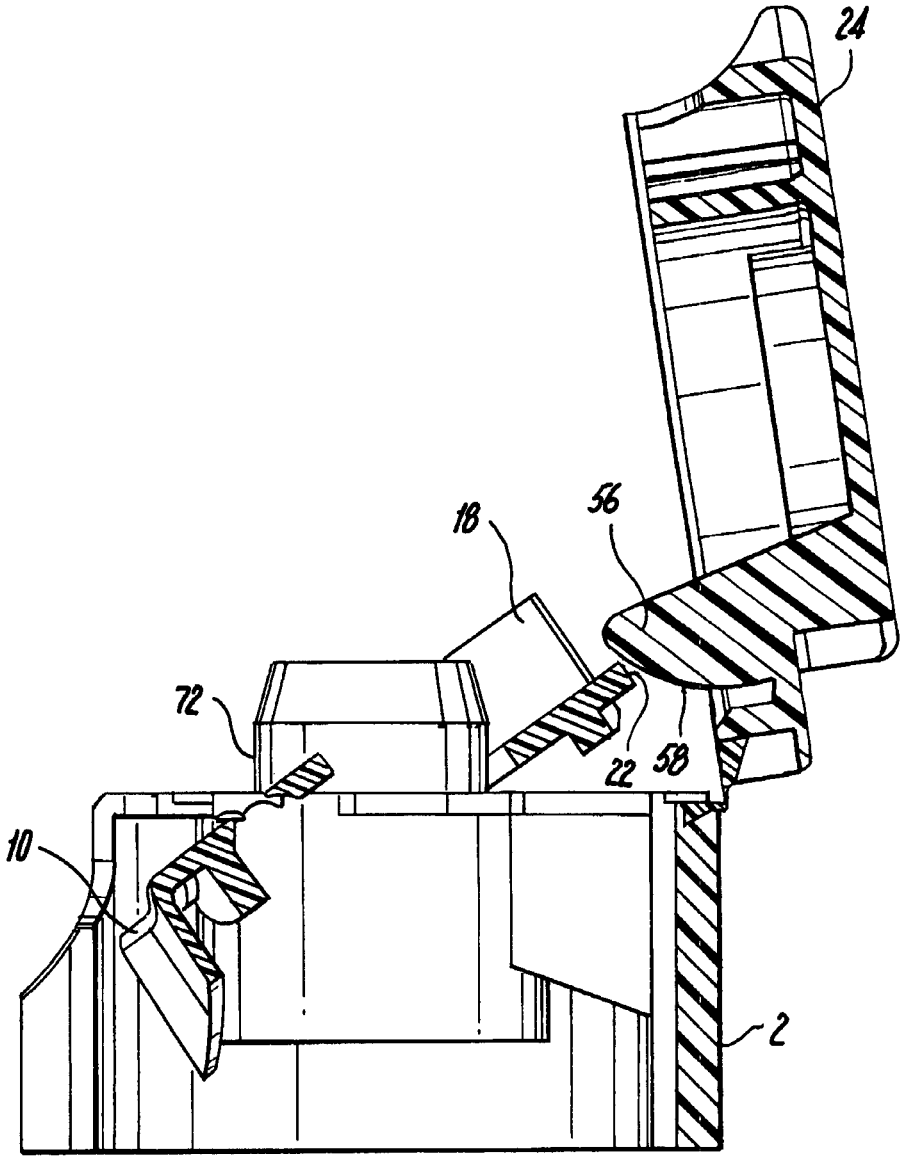

Additionally, in this third embodiment shown in FIGS. 11-30, each of the spaced apart arms 18 of the push button actuator 12 includes a flat surface 81 which engages the curved camming surface 58 of a respective camming protrusion 56. In the embodiment shown in FIG. 2, the spaced apart arms preferably included sloped or ramped surfaces 82 that extend to the exposed ends 22 of the arms. In this third embodiment, the surfaces 81 are substantially flat. The arms 18, on their underside and situated below surfaces 81, preferably include stiffening ribs 84 to add strength to the arms to engage the camming protrusions 56 of the lid with minimal or no deflection of the arms. Additionally, and as can be seen in FIG. 22, the camming surface 58 has a more curved, convex profile, as opposed to the concave profile of the camming surface 58 of the embodiment shown in FIG. 2.

As shown in FIGS. 24-33, pressure on the finger engagement portion 10 causes the push button actuator 12 to twistingly rotate on the cylindrical base 2, causing the two spaced apart arms 18 to lift and engage near their free ends the camming protrusions 56 of the lid. This engagement between the push button actuator 12 and the camming protrusions 56 forces the lid 24 to pivot with respect to the cylindrical base 2. At a certain point in this pivoting motion of the lid, the strap hinge 46 pulls the lid 24 open further to the non-interfering, obtuse angle shown in FIGS. 11, 14, 15, 20, 21 and 23, and maintains the lid 24 in this open position with respect to the cylindrical base 2. The boss 76 situated on the lid is unseated from the nozzle 72, and the nozzle is now open to allow the contents of the container on which the closure is mounted to freely pass therethrough and to be dispensed as desired by the user.

Figure 16:
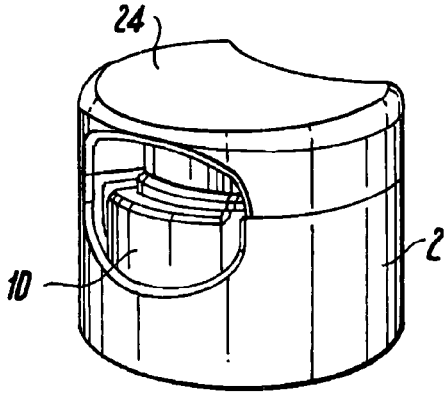
FIG. 16 is an isometric view of the second embodiment of the closure of the present invention, and illustrating the closure in the closed position.
Figure 17:
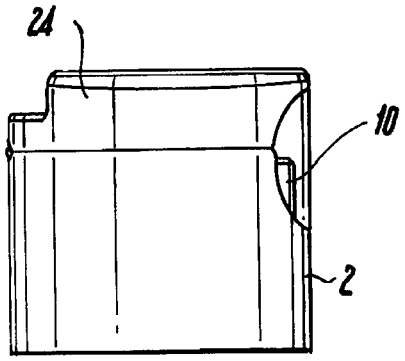
FIG. 17 is a side view of the closure of the present invention shown in FIGS. 11 through 16, with the closure being shown in the closed position.
Figure 18:
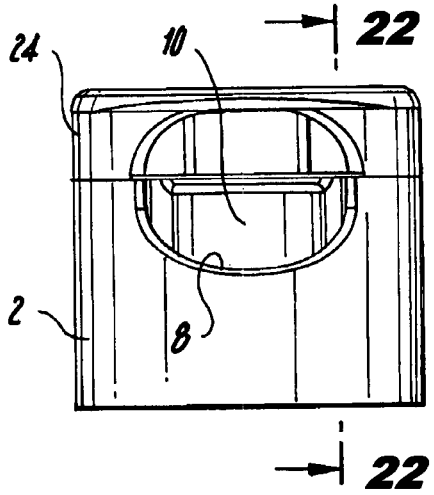
FIG. 18 is a front view of the closure of the present invention shown in FIGS. 11 through 17, and illustrating the closure in the closed position.
Figure 19:
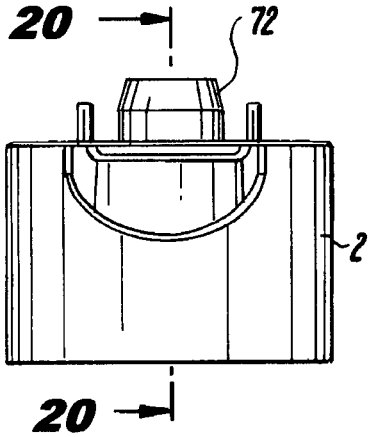
FIG. 19 is a front view of the closure of the present invention shown in FIGS. 11 through 18, with the lid portion of the closure being omitted from the figure.
Figure 20:
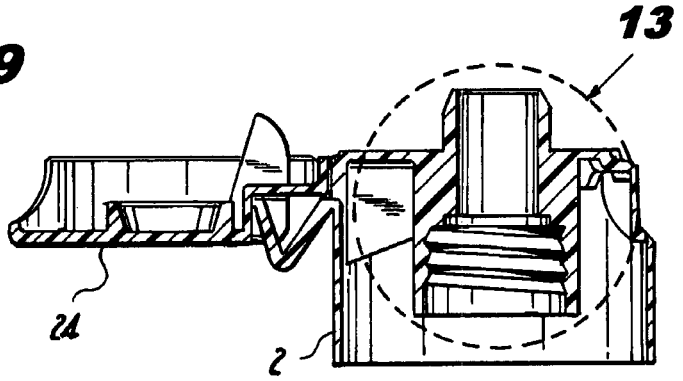
FIG. 20 is a cross-sectional view of the closure of the present invention shown in FIGS. 11 through 19, with the closure being shown in the open position.
Figure 21:
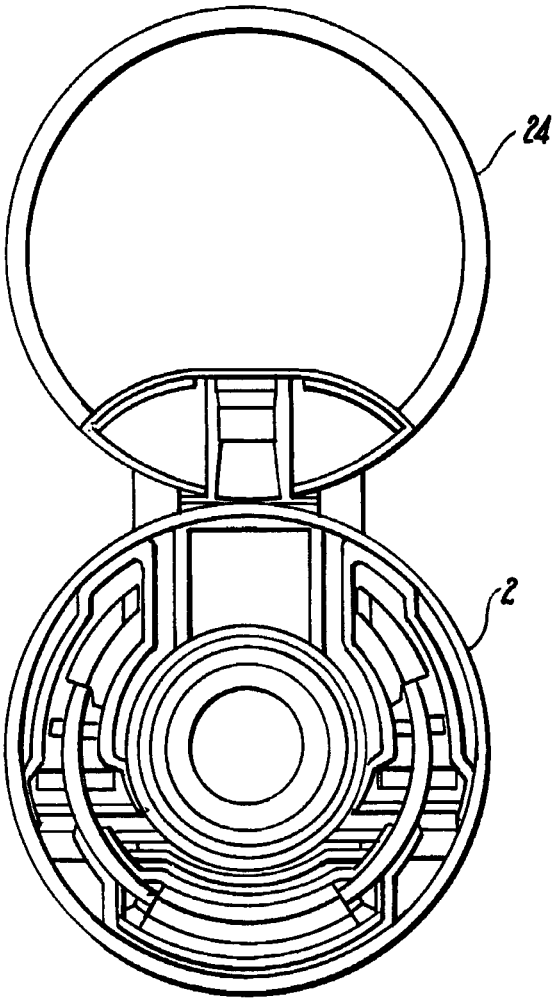
FIG. 21 is a bottom plan view of the closure of the present invention shown in FIGS. 11 through 20, with the closure being shown in the open position.

Also, as can be seen from FIGS. 16 and 18 of the drawings, a modification has been made to the finger engagement portion 10 and the notch 8 so that no cutout is formed in the upper wall or side wall of the lid 24.

Additionally, the overall height of the closure, measured from the lower edge of the base 2 to the upper surface of the lid 24, has been increased in this third embodiment, preferably by about 0.200 inches, to add a "back finger support" to allow the user to wrap his index finger partially about, and engage, the wall of the base 2 situated diametrically opposite the finger engagement portion 10 while he depresses the finger engagement portion with his thumb. This added height to the base 2 facilitates the user in grasping the closure with his hand in order to open the lid by using the finger engagement portion. Correspondingly, the threaded portion 78 of the nozzle 72 has also been lengthened in this third embodiment preferably by about 0.200 inches.

Furthermore, the two "support" hinges 38 have been changed to a "butterfly" design to reduce or eliminate any sharp edges that would have protruded outwardly from the periphery of the closure.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. A push button, flip top closure for a container, which comprises:

a base portion, the base portion including a side wall, the side wall having a notch formed therein;

a push button actuator situated on the base portion and pivotally mounted thereon to pivot with respect to the base portion;

a central cap having an orifice formed through the thickness thereof, the push button actuator at least partially surrounding the central cap; and a lid having a lower surface and being hingedly mounted to the base portion and positionable between at least a closed position to cover the orifice formed in the central cap and an open position to uncover the orifice formed in the central cap, the push button actuator selectively forcing the lid to pivot to the open position to allow the contents of the container on which the closure is mounted to pass through the orifice in the central cap;

wherein the push button actuator includes a finger engagement portion, the finger engagement portion being situated in alignment with the notch formed in the side wall so as to be exposed thereby to allow a user to press the finger engagement portion of the push button actuator to pivot the lid to the open position, the push button actuator being generally U-shaped and including a pair of spaced apart arms situated opposite the finger engagement portion, the central cap being situated between the pair of spaced apart arms;

and wherein each arm of the pair of spaced apart arms includes a free end, and the lid includes a pair of camming protrusions extending outwardly from the lower surface thereof, each camming protrusion of the pair of camming protrusions being disposed on the lid in alignment with a free end of a respective arm of the pair of spaced apart arms, each camming protrusion of the pair of camming protrusions having a camming surface formed thereon, the camming surface of each camming protrusion being engageable by the free end of the respective arm of the pair of spaced apart arms so that, when the exposed finger engagement portion of the push button actuator is pressed by the user, the free ends of the arms of the pair of spaced apart arms of the push button actuator exert a force on the camming protrusions to cause the lid to pivot to the open position to uncover the central cap and the orifice formed therein.

2. A push button, flip top closure as defined by claim 1, wherein the lid includes an upper surface and having a lid cutout formed in the upper surface thereof, the lid cutout being in alignment with the notch formed in the side wall of the base portion, the finger engagement portion of the push button actuator being further situated in alignment with the lid cutout so as to be exposed by the lid cutout and by the notch formed in the side wall of the base portion to allow the user to press the finger engagement portion of the push button actuator to pivot the lid to the open position.

3. A push button, flip top closure as defined by claim 1, wherein the lid includes a top wall and a side wall joined to the top wall, the top wall and the side wall of the lid having a lid cutout formed therein, the lid cutout being in alignment with the notch formed in the side wall of the base portion, the finger engagement portion of the push button actuator being further situated in alignment with the lid cutout so as to be exposed by the lid cutout and by the notch formed in the side wall of the base portion to allow the user to press the finger engagement portion of the push button actuator to pivot the lid to the open position.

4. A push button, flip top closure as defined by claim 3, wherein the top wall of the lid includes a lower surface; and wherein the lid further includes an internal wall extending outwardly from the lower surface of the top wall, the internal wall obscuring from the user a portion of the push button actuator when the closure is viewed by the user through the notch and lid cutout.

5. A push button, flip top closure as defined by claim 1, wherein the central cap includes an upper surface and the lid includes a lower surface; and wherein the closure further includes a nozzle protruding outwardly from the upper surface of the central cap, and a recess formed in the lower surface of the lid, the nozzle of the central cap being situated in alignment with the recess of the lid so as to be received thereby when the lid is in the closed position.

6. A push button, flip top closure as defined by claim 1, which further comprises:

a first hinge and a second hinge, the first hinge being in the form of a living hinge and hingedly connecting the lid to the base portion, the second hinge being in the form of a strap hinge and hingedly connecting the lid to the base portion.

7. A push button, flip top closure as defined by claim 1, wherein the push button actuator is integrally formed with and twistingly joined to the base portion.

8. A push button, flip top closure as defined by claim 7, wherein the base portion includes an inside surface; wherein the push button actuator includes opposite lateral sides; and wherein the push button, flip top closure further comprises twist pin extensions integrally joined to the inside surface of the base portion and the opposite lateral sides of the push button actuator, the twist pin extensions being partially twistable to allow the push button actuator to at least partially rotate on the base portion.

9. A push button, flip top closure as defined by claim 1, wherein the push button, flip top closure is formed as one continuous piece by injection molding, each of the base portion, push button actuator, central cap and lid being integrally formed together.

* * * * *